US010974887B2

(12) United States Patent
Freedman et al.

(10) Patent No.: US 10,974,887 B2
(45) Date of Patent: Apr. 13, 2021

(54) CONTAINERS, CONTAINER INSERTS AND ASSOCIATED METHODS FOR MAKING CONTAINERS

(71) Applicant: CSP TECHNOLOGIES, INC., Auburn, AL (US)

(72) Inventors: Jonathan R. Freedman, Auburn, AL (US); Donald Lee Huber, Auburn, AL (US)

(73) Assignee: CSP TECHNOLOGIES, INC., Auburn, AL (US)

( * ) Notice: Subject to any disclaimer, the term of this patent is extended or adjusted under 35 U.S.C. 154(b) by 127 days.

(21) Appl. No.: 16/076,719

(22) PCT Filed: Feb. 9, 2017

(86) PCT No.: PCT/US2017/017141
§ 371 (c)(1),
(2) Date: Aug. 9, 2018

(87) PCT Pub. No.: WO2017/139446
PCT Pub. Date: Aug. 17, 2017

(65) Prior Publication Data

US 2019/0039804 A1 Feb. 7, 2019

Related U.S. Application Data

(60) Provisional application No. 62/293,048, filed on Feb. 9, 2016.

(51) Int. Cl.
*B65D 81/26* (2006.01)
*B65D 43/16* (2006.01)

(52) U.S. Cl.
CPC ..... *B65D 81/266* (2013.01); *B65D 43/162* (2013.01); *B65D 81/264* (2013.01)

(58) Field of Classification Search
CPC .... B65D 81/00–266; B65D 43/00–162; B65D 5/566; B65D 90/041;
(Continued)

(56) References Cited

U.S. PATENT DOCUMENTS 4,783,056 A 11/1988 Abrams
5,911,937 A 6/1999 Hekal
(Continued)

FOREIGN PATENT DOCUMENTS

CN 102616473 A 8/2012
DE 3120011 A1 12/1982
(Continued)

OTHER PUBLICATIONS

Chinese Search Report for CN Application No. CN 201780020967.8, dated Jun. 5, 2019.
(Continued)

*Primary Examiner* — Kareen K Thomas
(74) *Attorney, Agent, or Firm* — Mark T. Vogelbacker; Eckert Seamans Cherin & Mellott, LLC

(57) ABSTRACT

A container includes a container body (201), optionally a lid (220), and an insert (100) secured, optionally fixedly secured within an interior of the container body. The insert has a base material, optionally a polymer, for providing structure to the insert, and a desiccant. The insert further has an opening leading to an interior compartment (102) configured for housing products and an outer surface (104) facing an inner surface of the container body. A void is provided between an exposed portion of the outer surface of the insert and a portion of the inner surface of the container body. At least one fluid pathway is provided between the void and the interior compartment of the insert.

24 Claims, 11 Drawing Sheets

(58) Field of Classification Search
CPC .. B65D 2081/001; B65D 81/34; B65D 23/02; B65D 27/005; B65D 35/14; B65D 2251/10; B29L 2031/712
USPC ..... 220/23.86, 23.87, 23.88, 501, 509, 810, 220/495.01, 495.03; 215/394
See application file for complete search history.

(56) References Cited

U.S. PATENT DOCUMENTS

| | | | | |
|---|---|---|---|---|
| 6,080,350 | A | 6/2000 | Hekal | |
| 6,124,006 | A | 9/2000 | Hekal | |
| 6,130,263 | A | 10/2000 | Hekal | |
| 6,174,952 | B1 | 1/2001 | Hekal et al. | |
| 6,214,255 | B1 | 4/2001 | Hekal | |
| 6,221,446 | B1 | 4/2001 | Hekal | |
| RE37,676 | E | 4/2002 | Abrams et al. | |
| 7,501,093 | B2 | 3/2009 | Demelo et al. | |
| 8,919,545 | B2 * | 12/2014 | Chang | B65D 43/162 206/204 |
| 8,919,546 | B2 | 12/2014 | Wada et al. | |
| 2005/0118071 | A1 * | 6/2005 | Sacherer | B01L 9/52 422/562 |
| 2006/0144733 | A1 * | 7/2006 | Wu | B65D 43/162 206/368 |
| 2006/0219727 | A1 * | 10/2006 | Giraud | B65D 50/045 220/839 |
| 2008/0012172 | A1 * | 1/2008 | Merical | B29C 45/1646 264/254 |
| 2008/0035658 | A1 * | 2/2008 | Caulfield | B65D 43/162 220/839 |
| 2008/0185301 | A1 * | 8/2008 | Merical | B29C 49/0005 206/204 |
| 2010/0140116 | A1 * | 6/2010 | Stiene | B65D 81/266 206/204 |
| 2011/0056951 | A1 * | 3/2011 | Wooldridge | B65D 81/267 220/495.01 |
| 2011/0089187 | A1 * | 4/2011 | Steiger | B65D 43/162 220/839 |
| 2011/0127176 | A1 | 6/2011 | Chang et al. | |
| 2011/0127269 | A1 | 6/2011 | Bucholtz et al. | |
| 2012/0193246 | A1 | 8/2012 | Chang | |
| 2013/0220844 | A1 | 8/2013 | Logel et al. | |
| 2016/0130045 | A1 * | 5/2016 | Giraud | B65D 43/22 53/492 |
| 2017/0144804 | A1 * | 5/2017 | Bois | B65D 43/169 |

FOREIGN PATENT DOCUMENTS

| | | | |
|---|---|---|---|
| JP | 2004136933 | A | 5/2004 |
| WO | 9117926 | A1 | 11/1991 |
| WO | 9639343 | A1 | 12/1996 |

OTHER PUBLICATIONS

International Search Report for PCT/US2017/017141, dated Mar. 13, 2017.

* cited by examiner

CONTAINERS, CONTAINER INSERTS AND ASSOCIATED METHODS FOR MAKING CONTAINERS

CROSS-REFERENCE TO RELATED APPLICATIONS

This application is a U.S. National Phase of International Application No. PCT/US2017/017141 filed Feb. 9, 2017, which claims priority to U.S. Provisional Patent Application No. 62/293,048 filed Feb. 9, 2016, which are incorporated herein by reference in their entirety.

FIELD OF THE INVENTION

The present invention relates generally to containers adapted to house products that are sensitive to ambient conditions, e.g., certain medications and diagnostic test strips. The present invention also relates to inserts for such containers. The present invention further relates to methods for making such containers.

BACKGROUND

The efficacy of some products, particularly in the medical field, can be adversely affected by ambient conditions, e.g., through exposure to moisture or oxygen. Medications, for example, may be compromised by moisture. As the medication absorbs moisture, the medication may become less effective for its intended purpose. Diagnostic test strips, such as blood glucose test strips that are used in diabetic care, can also be adversely affected by exposure to moisture.

Medication and diagnostic test strips can encounter moisture at multiple times in their lifecycles. Such an encounter may occur during the manufacturing stage, during shipping, while the product is in storage prior to being sold, while the product is in storage after being sold, and each and every time a container containing the product is opened so that the product can be used. Even if the medication or diagnostic test strips have been manufactured and stored in a moisture tight container, each time the container is opened so that the medication or test strips can be extracted, moisture enters the container. The moisture that enters the container surrounds the medication or test strips inside the container after the container is closed. Such exposure to moisture can adversely affect the medication or test strips and reduce shelf life.

Because a medication/test strip container is repeatedly opened and closed, and because moisture enters the container each time it is opened, it is often provided with a desiccating unit adapted to absorb moisture. The desiccating unit typically includes desiccant within a small bag or canister that comingles with the medication. Various problems may be associated with such a small bag or canister. For example, the bag/canister may be ingested by a small child, which can result in a choking hazard. Also, it is possible that the bag/canister may be thrown away after the first time the container is opened. With the bag/canister absent, there is nothing to absorb moisture as the container continues to be opened and closed each time a consumer removes products therefrom.

To address the aforementioned deficiencies associated with loose desiccant bags/canisters, desiccant entrained immovable inserts have been provided in containers. Such inserts may comprise desiccant entrained polymer formulations including a base polymer (for structure), a desiccant and optionally a channeling agent. These types of inserts and methods of making and assembling the same are disclosed, e.g., in applicant's U.S. Pat. Nos. 5,911,937, 6,214,255, 6,130,263, 6,080,350, 6,174,952, 6,124,006 and 6,221,446, and U.S. Pat. Pub. No. 2011/0127269, all of which are incorporated by reference herein in their entireties. These desiccant inserts provide distinct advantages over loosely placed desiccant bags/canisters.

One challenge with desiccant inserts relates to maximizing exposure of the insert's surface area to the air within the container to absorb moisture to a desired level of efficacy and efficiency. Typical desiccant inserts are provided in the form of a sleeve, liner or the like, having an inner surface exposed to air within the container, but an outer surface that is flush with—or integral with—the inner surface of the container body. As such, only approximately half of the outer surface of the insert is in contact with air inside the container. While desiccant inserts are typically designed to promote communication of moisture in the air to desiccant within the insert (e.g., via channels made by channeling agents in the desiccant entrained polymer), limiting surface contact of the air to only the inner surface of the insert may not provide optimal moisture absorption activity. In addition, for some applications it may be desirable to use channeling agents that provide slower moisture uptake rates, because they may provide other desirable properties. In such circumstances, providing only the inner wall of the insert as exposed surface area to moisture may provide insufficient moisture absorption capacity for some applications.

There is thus a need for containers with desiccant inserts that increase surface area contact of the desiccant entrained polymer that may be exposed to air within the container. A similar need exists with respect to inserts entrained with alternative active agents, such as oxygen scavengers.

SUMMARY OF THE INVENTION

Accordingly, in one aspect, a container is provided. The container comprises a container body having a base and a sidewall extending from it, the container body having an inner surface defining an interior of the container body. The container body has an opening leading to the interior. Optionally, a lid is provided. The lid is movable with respect to the container body to move the container between a closed position in which the lid covers the opening and an open position in which the opening is exposed. The container further includes an insert secured, optionally fixedly secured, within the interior of the container body. The insert is made from a base material, e.g., a polymer, for providing structure to the insert, and an active agent, e.g. a desiccant. Optionally, the base material and desiccant are provided in a blend. The insert has an opening leading to an interior compartment configured for housing products and an outer surface facing the inner surface of the container body. A void is provided between an exposed portion of the outer surface of the insert and a portion of the inner surface of the container body. At least one fluid pathway is provided between the void and the interior compartment of the insert. Optionally, this enables air and moisture within the interior space to travel through the fluid pathway(s) to the void and be absorbed by the desiccant on or near the exposed portion of the outer surface of the insert.

In another aspect, there is provided an insert for the aforementioned container.

In another aspect there is provided a method for making the aforementioned container. The method includes providing a container body having a base and a sidewall extending therefrom. The container body has an inner surface defining an interior of the container body. The container body further has an opening leading to the interior. The method further includes optionally providing a lid that is movable with respect to the container body to move the container between a closed position in which the lid covers the opening and an open position in which the opening is exposed. The method further includes securing an insert, optionally fixedly securing the insert, within the interior of the container body, the insert having a base material and an active agent, e.g., a desiccant. The base material provides structure to the insert and is optionally a polymer. The insert has an opening leading to an interior compartment configured for housing products and an outer surface facing the inner surface of the container body. The method further includes forming a void between an exposed portion of the outer surface of the insert and a portion of the inner surface of the container body and forming at least one fluid pathway between the void and the interior compartment of the insert.

BRIEF DESCRIPTION OF THE DRAWINGS

The invention will be described in conjunction with the following drawings in which like reference numerals designate like elements and wherein.

DETAILED DESCRIPTION OF THE PREFERRED EMBODIMENTS

Definitions

Figure 1:
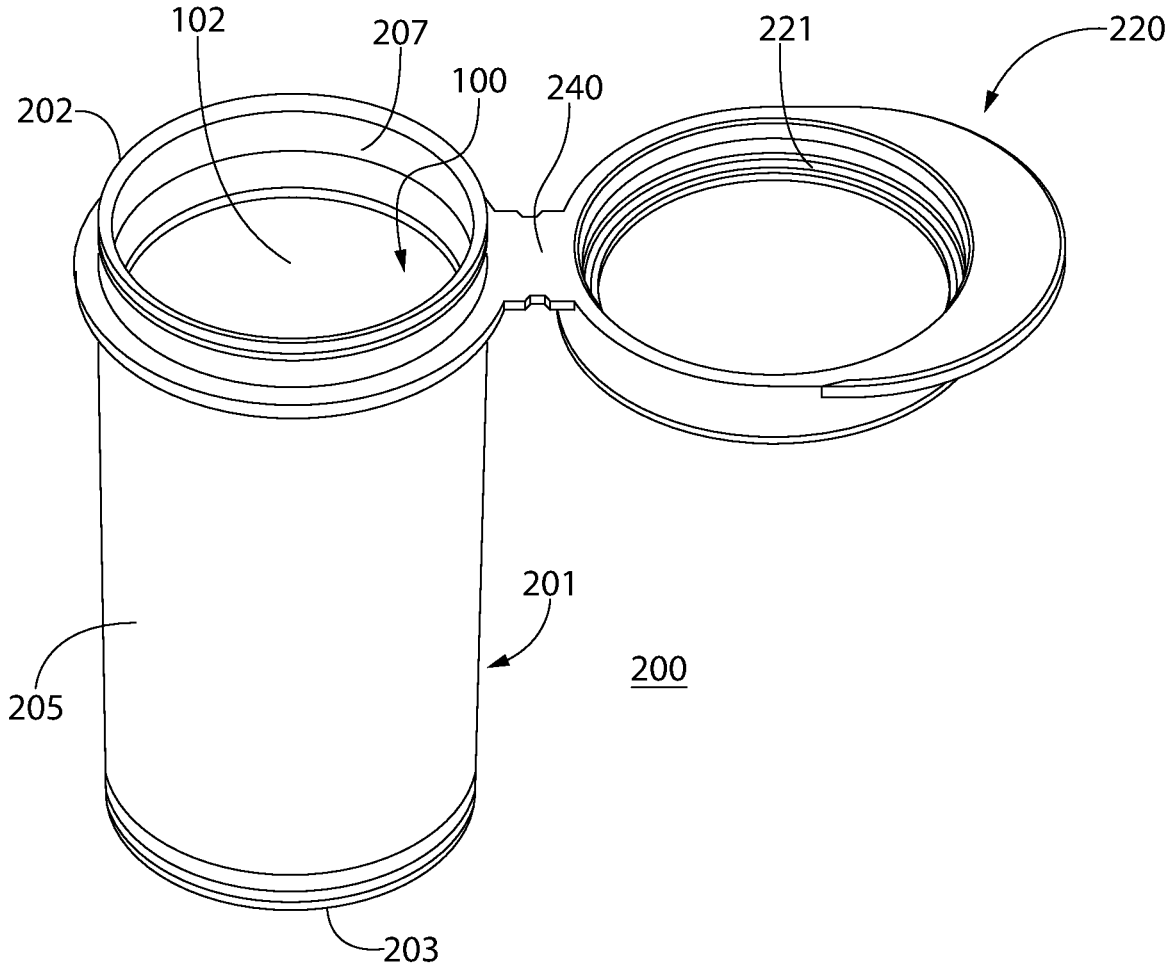
FIG. 1 is an isometric view of a container, in accordance with one non-limiting embodiment of the disclosed concept.

One feature of the disclosed concept is directed to an insert made from an entrained active material. The following definitions and examples explain aspects of such materials.

As used herein, the term "active" is defined as capable of acting on, interacting with or reacting with a selected material (e.g., moisture or oxygen). Examples of such actions or interactions may include absorption, adsorption (sorption, generally) or release of the selected material.

As used herein, the term "active agent" is defined as a material that (1) is preferably immiscible with the base material (e.g., polymer) and when mixed and heated with the base polymer and the channeling agent, will not melt, i.e., has a melting point that is higher than the melting point for either the base polymer or the channeling agent, and (2) acts on, interacts or reacts with a selected material. The term "active agent" may include but is not limited to materials that absorb, adsorb or release the selected material(s). Active agents according to the invention may be in the form of particles such as minerals (e.g., molecular sieve or silica gel, in the case of desiccants), but the invention should not be viewed as limited only to particulate active agents. For example, in some embodiments, an oxygen scavenging formulation may be made from a resin which acts as, or as a component of, the active agent.

As used herein, the term "base material" is a component (preferably a polymer) of an entrained active material, other than the active agent, that provides structure for the entrained material.

As used herein, the term "base polymer" is a polymer optionally having a gas transmission rate of a selected material that is substantially lower than, lower than or substantially equivalent to, that of the channeling agent. By way of example, such a transmission rate would be a water vapor transmission rate in embodiments where the selected material is moisture and the active agent is a water absorbing desiccant. The primary function of the base polymer is to provide structure for the entrained polymer. Suitable base polymers may include thermoplastic polymers, e.g., polyolefins such as polypropylene and polyethylene, polyisoprene, polybutadiene, polybutene, polysiloxane, polycarbonates, polyamides, ethylene-vinyl acetate copolymers, ethylene-methacrylate copolymer, poly(vinyl chloride), polystyrene, polyesters, polyanhydrides, polyacrylianitrile, polysulfones, polyacrylic ester, acrylic, polyurethane and polyacetal, or copolymers or mixtures thereof.

Referring to such a comparison of the base polymer and channeling agent water vapor transmission rate, in one embodiment, the channeling agent has a water vapor transmission rate of at least two times that of the base polymer. In another embodiment, the channeling agent has a water vapor transmission rate of at least five times that of the base polymer. In another embodiment, the channeling agent has a water vapor transmission rate of at least ten times that of the base polymer. In still another embodiment, the channeling agent has a water vapor transmission rate of at least twenty times that of the base polymer. In still another embodiment, the channeling agent has a water vapor transmission rate of at least fifty times that of the base polymer. In still another embodiment, the channeling agent has a water vapor transmission rate of at least one hundred times that of the base polymer.

As used herein, the term "channeling agent" or "channeling agents" is defined as a material that is immiscible with the base polymer and has an affinity to transport a gas phase substance at a faster rate than the base polymer. Optionally, a channeling agent is capable of forming channels through the entrained polymer when formed by mixing the channeling agent with the base polymer. Optionally, such channels are capable of transmitting a selected material through the entrained polymer at a faster rate than in solely the base polymer.

As used herein, the term "channels" or "interconnecting channels" is defined as passages formed of the channeling agent that penetrate through the base polymer and may be interconnected with each other.

As used herein, the term "entrained polymer" is defined as a monolithic material formed of at least a base polymer with an active agent and optionally also a channeling agent entrained or distributed throughout. An entrained polymer thus includes two-phase polymers and three phase polymers. A "mineral loaded polymer" is a type of entrained polymer, wherein the active agent is in the form of minerals, e.g., mineral particles such as molecular sieve or silica gel. The term "entrained material" is used herein to connote a monolithic material comprising an active agent entrained in a base material wherein the base material may or may not be polymeric.

As used herein, the term "monolithic," "monolithic structure" or "monolithic composition" is defined as a composition or material that does not consist of two or more discrete macroscopic layers or portions. Accordingly, a "monolithic composition" does not include a multi-layer composite.

As used herein, the term "phase" is defined as a portion or component of a monolithic structure or composition that is uniformly distributed throughout, to give the structure or composition it's monolithic characteristics.

As used herein, the term "selected material" is defined as a material that is acted upon, by, or interacts or reacts with an active agent and is capable of being transmitted through the channels of an entrained polymer. For example, in embodiments in which a desiccant is used as an active agent, the selected material may be moisture or a gas that can be absorbed by the desiccant. In embodiments in which a releasing material is used as an active agent, the selected material may be an agent released by the releasing material, such as moisture, fragrance, or an antimicrobial agent (e.g., chlorine dioxide). In embodiments in which an adsorbing material is used as an active agent, the selected material may be certain volatile organic compounds and the adsorbing material may be activated carbon.

As used herein, the term "three phase" is defined as a monolithic composition or structure comprising three or more phases. An example of a three phase composition according to the invention would be an entrained polymer formed of a base polymer, active agent, and channeling agent. Optionally, a three phase composition or structure may include an additional phase, e.g., a colorant.

Entrained polymers may be two phase formulations (i.e., comprising a base polymer and active agent, without a channeling agent) or three phase formulations (i.e., comprising a base polymer, active agent and channeling agent). Entrained polymers are described, for example, in U.S. Pat. Nos. 5,911,937, 6,080,350, 6,124,006, 6,130,263, 6,194,079, 6,214,255, 6,486,231, 7,005,459, and U.S. Pat. Pub. No. 2016/0039955, each of which is incorporated herein by reference as if fully set forth.

Exemplary Entrained Polymers

An entrained material or polymer includes a base material (e.g., polymer) for providing structure, optionally a channeling agent and an active agent. The channeling agent forms microscopic interconnecting channels through the entrained polymer. At least some of the active agent is contained within these channels, such that the channels communicate between the active agent and the exterior of the entrained polymer via microscopic channel openings formed at outer surfaces of the entrained polymer. The active agent can be, for example, any one of a variety of absorbing, adsorbing or releasing materials, as described in further detail below. While a channeling agent is preferred, the invention broadly includes entrained materials that optionally do not include channeling agents, e.g., two phase polymers.

In any embodiment, suitable channeling agents may include a polyglycol such as polyethylene glycol (PEG), ethylene-vinyl alcohol (EVOH), polyvinyl alcohol (PVOH), glycerin polyamine, polyurethane and polycarboxylic acid including polyacrylic acid or polymethacrylic acid. Alternatively, the channeling agent can be, for example, a water insoluble polymer, such as a propylene oxide polymerisate-monobutyl ether, such as Polyglykol B01/240, produced by CLARIANT. In other embodiments, the channeling agent could be a propylene oxide polymerisate monobutyl ether, such as Polyglykol B01/20, produced by CLARIANT, propylene oxide polymerisate, such as Polyglykol D01/240, produced by CLARIANT, ethylene vinyl acetate, nylon 6, nylon 66, or any combination of the foregoing.

Suitable active agents according to the invention include absorbing materials, such as desiccating compounds. If the active agent is a desiccant, any suitable desiccant for a given application may be used. Typically, physical absorption desiccants are preferred for many applications. These may include molecular sieves, silica gels, clays and starches. Alternatively, the desiccant may be a chemical compound that forms crystals containing water or compounds which react with water to form new compounds.

Optionally, in any embodiment, the active agent may be an oxygen scavenger, e.g., an oxygen scavenging resin formulation.

Suitable absorbing materials may also include: (1) metals and alloys such as, but not limited to, nickel, copper, aluminum, silicon, solder, silver, gold; (2) metal-plated particulates such as silver-plated copper, silver-placed nickel, silver-plated glass microspheres; (3) inorganics such as $BaTiO_3$, $SrTiO_3$, $SiO_2$, $Al_2O_3$, ZnO, $TiO_2$, MnO, CuO, $Sb_2O_3$, WC, fused silica, fumed silica, amorphous fused silica, sol-gel silica, sol-gel titanates, mixed titanates, ion exchange resins, lithium-containing ceramics, hollow glass microspheres; (4) carbon-based materials such as carbon, activated charcoal, carbon black, ketchem black, diamond powder; (5) elastomers, such as polybutadiene, polysiloxane, and semi-metals, ceramic and; (6) other fillers and pigments.

In another example, the absorbing material may be a carbon dioxide scavenger, such as calcium oxide. In the presence of moisture and carbon dioxide, the calcium oxide is converted to calcium carbonate. Accordingly, calcium oxide may be used as the absorbing material in applications where absorption of carbon dioxide is needed. Such applications include preserving fresh foods (e.g., fruits and vegetables) that give off carbon dioxide.

Other suitable active agents according to the invention include releasing materials. Such materials may comprise any suitable material that will release the selected material from the releasing material. The selected material released from the releasing material could be in the form of a solid, gel, liquid or gas. These substances can perform a variety of functions including: serving as a fragrance, flavor, or perfume source; supplying a biologically active ingredient such as pesticide, pest repellent, antimicrobials, bait, aromatic medicines, etc.; providing humidifying or desiccating substances; delivering air-borne active chemicals, such as corrosion inhibitors; ripening agents and odor-making agents.

Suitable biocides for use as releasing materials in the entrained polymers of the present invention may include, but are not limited to, pesticides, herbicides, nematacides, fungicides, rodenticides and/or mixtures thereof. In addition to the biocides, active agents may also release nutrients, plant growth regulators, pheromones, defoliants and/or mixture thereof.

Quaternary ammonium compounds can also be used as releasing materials according to the invention. Such compounds not only function as surfactants, but also impart to the surface of the entrained polymer aseptic properties or establish conditions for reducing the number of microbial organisms, some of which can be pathogenic. Numerous other antimicrobial agents, such as benzalkonium chloride and related types of compounds as hexachlorophene, may also be used as releasing agents according to the invention. Other antimicrobial agents, such as chlorine dioxide releasing agents may be used.

Other potential releasing materials include fragrances, including natural, essential oils and synthetic perfumes, and blends thereof. Typical perfumery materials which may form part of, or possibly the whole of, the active ingredient include: natural essential oils such as lemon oil, mandarin oil, clove leaf oil, petitgrain oil, cedar wood oil, patchouli oil, lavandin oil, neroli oil, ylang oil, rose absolute or jasmin absolute; natural resins such as labdanum resin or olibanum resin; single perfumery chemicals which may be isolated from natural sources or manufactured synthetically, as for example alcohols such as geraniol, nerol, citronellol, linalol, tetrahydrogeraniol, betaphenylethyl alcohol, methyl phenyl carbinol, dimethyl benzyl carbinol, menthol or cedrol; acetates and other esters derived from such alcohols-aldehydes such as citral, citronellal, hydroxycitronellal, lauric aldehyde, undecylenic aldehyde, cinnamaldehyde, amyl cinnamic aldehyde, vanillin or heliotropin; acetals derived from such aldehydes; ketones such as methyl hexyl ketone, the ionones and methylionones; phenolic compounds such as eugenol and isoeugenol; synthetic musks such as musk xylene, musk ketone and ethylene brassylate.

It is believed that the higher the active agent concentration in the mixture, the greater the absorption, adsorption or releasing capacity (as the case may be) will be of the final composition. However, too high an active agent concentration could cause the entrained polymer to be more brittle and the molten mixture of active agent, base polymer and channeling agent to be more difficult to either thermally form, extrude or injection mold. In one embodiment, the active agent loading level can range from 10% to 80%, preferably 40% to 70%, more preferably from 40% to 60%, and even more preferably from 45% to 55% by weight with respect to the total weight of the entrained polymer. Optionally, channeling agent may be provided in a range of 2% to 10% by weight, preferably about 5%. Optionally, the base polymer may range from 10% to 50% by weight of the total composition, preferably from 20% to 35% by weight. Optionally, a colorant is added, e.g., at about 2% by weight of the total composition

Container and Entrained Active Material Insert Embodiments

Referring now in detail to the various figures of the drawings wherein like reference numerals refer to like parts, FIG. 1 illustrates a container 200 in accordance with one non-limiting embodiment of the disclosed concept. Container 200 includes a container body 201, optionally a lid 220, and an insert entrained with an active agent, e.g., a desiccant insert 100. The exemplary insert 100 is a desiccant insert (i.e., entrained with a desiccant as active agent). However, it should be understood that alternative active agents may be used in place of or in combination with desiccant (for example, the insert 100 may alternatively be an oxygen scavenger insert) according to optional embodiments of the disclosed concept.

In the exemplary embodiment, container body 201 and insert 100 are generally cylindrical-shaped, although other three-dimensional (length-wise) shapes are contemplated as well, including elliptical, square, rectangle, prism, etc. It should be appreciated that the insert can be any monolithic composition entrained with an active agent.

Desiccant insert 100 is comprised of a desiccant that is entrained in another material, e.g., a thermoplastic polymer. Desiccant is incorporated into desiccant insert 100 in various manners that are known to one of ordinary skill in the art. Desiccant insert 100 may be formed, for example in a single-shot injection molding process. Alternatively, desiccant insert 100 may be formed as part of a two-shot molding process in forming a container, wherein one shot forms container body 201 (and optionally lid 220) and another shot forms desiccant insert 100.

When entraining a desiccant within a rigid polymer matrix to make the insert 100, a moisture impermeable polymer encasement may be created about the individual desiccant particles contained within a structure. As described above, channeling agents, may be combined with a polymer base matrix that is used in the formation of rigid bodies. In this manner desiccant insert 100 is preferably comprised of a base polymer, the active agent (desiccant) and optionally a channeling agent (i.e., a three-phase desiccant polymer). As discussed above, in some embodiments, omission of the channeling agent may be desired, so as to provide a two-phase polymer comprising a base polymer and active agent. The base polymer into which the desiccant and (optionally) channeling agent are blended to form a monolithic composition include injection moldable thermoplastics, for example, polyethylene or polypropylene.

The desiccant and channeling agent may be added to the polymer when the polymer base is in a molten state prior to forming it into a container so that these additive agents may be blended and thoroughly mixed throughout the base polymer material. After thoroughly blending the several materials together and the mixing process is subsequently stopped, the channeling agent will separate from the polymer base and form microscopic veins or channels that act as moisture communicating passages throughout the polymer. Ethylene-vinyl alcohol (EVOH) and polyvinyl alcohol (PVOH) have been found to be particularly suited as channeling agents for some applications. Each of these alcohols may be mechanically mixed with base polymers, such as polypropylene and polyethylene, and then allowed to separate into domains while still in the molten state. The microscopic channels are open at the surface of the polymer structures and thereby provide access for moisture to interior portions of the polymer matrix.

Figure 2:
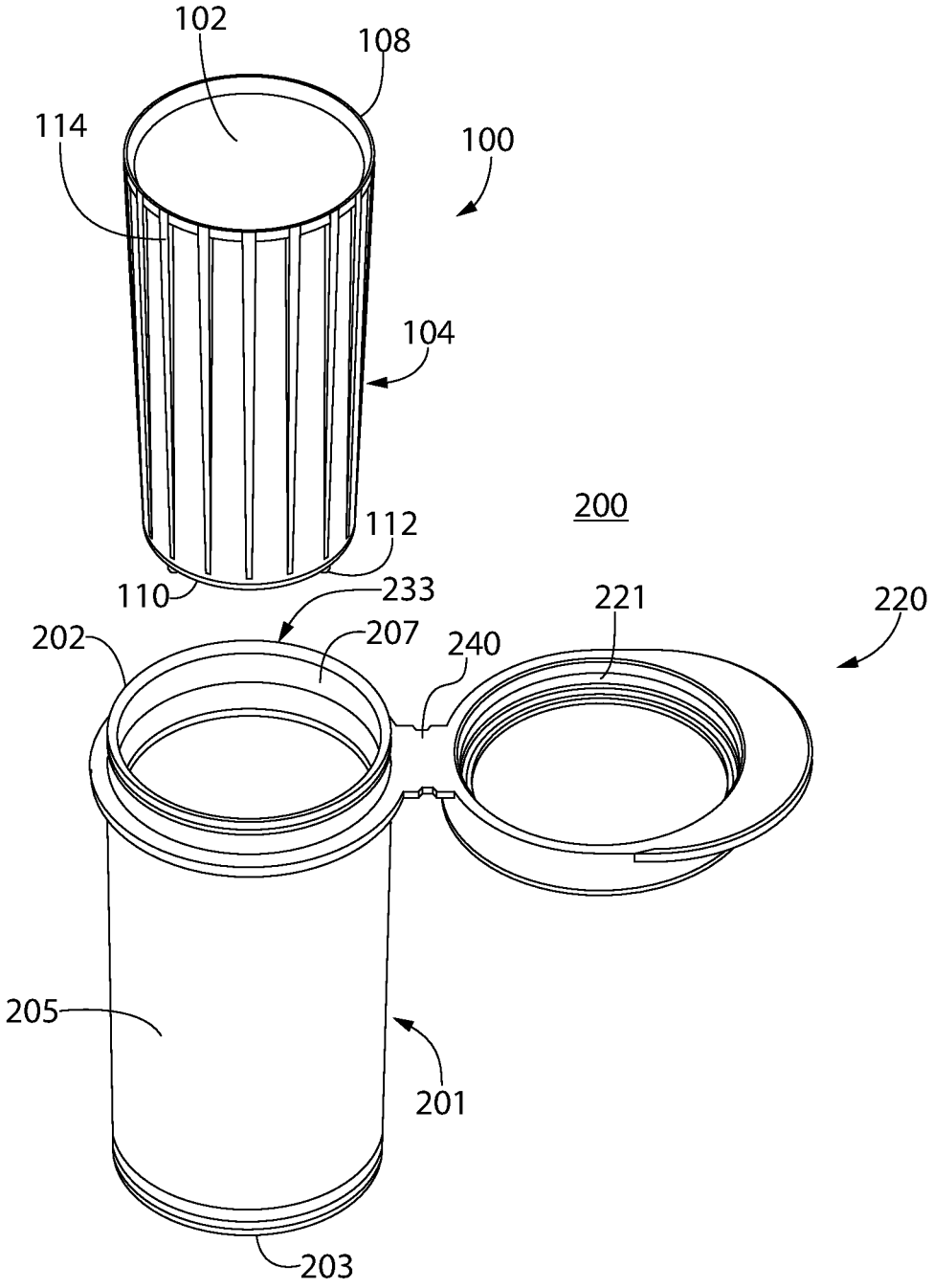
FIG. 2 is an exploded isometric view of the container of FIG. 1.
Figure 3:
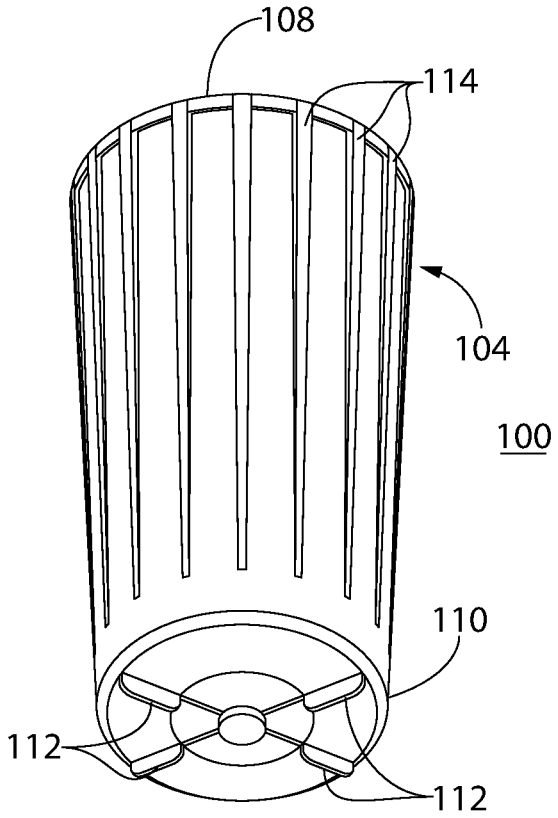
FIG. 3 is an isometric view of an insert for the container of FIG. 2.

Desiccant insert 100 is shown most clearly in FIG. 2 and FIG. 3. Insert 100 includes an opening leading to an interior compartment 102 for housing products (e.g., without limitation, medication and diagnostic test strips) and an outer surface 104. Interior compartment 102 may have a variety of shapes associated therewith including a shape that corresponds generally to the outer shape of insert 100 (e.g., cup-like). Optionally, the insert 100 is tube-like and without a bottom (not shown) in which case the interior compartment would be open on two ends instead of one. Insert 100 further has a top-edge 108 and a bottom end 110 located opposite and distal to top-edge 108. In one exemplary embodiment, top-edge 108 defines an opening leading into interior compartment 102, and bottom end 110 is generally disc-shaped. Insert 100 extends from top-edge 108 to bottom end 110. Bottom end 110 is preferably closed, with the same material used throughout insert 100. However, in some embodiments, bottom end 110 is deleted (or partially deleted) so that insert 100 is a cylinder with both ends open.

Continuing to refer to FIG. 2 and FIG. 3, protrusion(s), e.g., without limitation, detents 112 and ridges 114, are provided on outer surface 104. Detents 112 extend from bottom end 110 away from top-edge 108 in order to create space between bottom end 110 and container body 201. Stated differently, detents 112 slightly elevate bottom end 110 from a base 203 of container body 201. By elevating bottom end 110, bottom end 110 is well exposed to air within a void between container body 201 and insert 100. In this manner, and as will be discussed below, bottom end 110 is able to absorb moisture within container body 201. As shown, ridges 114 may be a plurality of evenly spaced ridges that are situated parallel to each other and extend longitudinally from near the top-edge 108 to near the bottom end 110. In yet another embodiment, ridges 114 do not extend the entire distance from top-edge 108 to bottom end 110. Ridges 114 may extend only part of the distance or may each exist as a line of discontinuous ridges with spaces therebetween. The thickness of ridges 114 may be any of a variety of dimensions. In the example shown in FIG. 2 and FIG. 3, ridges 114 are tapered from top-edge 108 to bottom end 110 (i.e., they are thicker towards the top of insert 100 and thinner towards the bottom of insert 100). In an embodiment in which insert 100 is assembled into container body 201 by press fit, tapering of ridges 114 may advantageously facilitate automated insertion of insert 100 into container body 201 upon which upper portions of ridges 114 establish an interference fit with container body 201.

In an exemplary embodiment, insert 100 is optionally rigid and thus not subject to deformation when minimal pressure is applied thereto. This optional rigidity may be helpful, for example, in some applications such as when insert 100 is used in combination with an outer container that is not round (and that is for example elliptical, etc.). This optional rigidity may provide support to resist deflection about sealing surfaces of non-round (e.g. elliptical) containers (which may promote moisture tightness). Non-round containers, e.g., elliptical containers, are disclosed in U.S. Pat. Pub. No. 2011/0127269, which is hereby incorporated by reference in its entirety.

Moisture tightness may be advantageous to at least partially prevent moisture from entering a container and reducing the efficacy of medicine or test strips included therein. When moisture enters a container, moisture ingress has occurred. In accordance with any embodiment of the invention, a container in which desiccant is included may be moisture tight. The term "moisture tight" with respect to a container is defined as a container having a moisture ingress rate of less than 1000 micrograms per day, at 80% relative humidity and 22.2° C. Moisture ingress may thus fall within one of several ranges. One such range is between 25 and 1000 micrograms per day under the aforementioned ambient conditions. Another such range is 50-1000 micrograms per day under the aforementioned ambient conditions. A further such range is 100-1000 micrograms per day under the aforementioned ambient conditions.

In an exemplary embodiment, it may be desirable to increase the exposed surface area of insert 100. In this manner, a larger amount of surface area of desiccant would be exposed to air in container 200 in order to facilitate absorption of moisture. Thus, it may be desirable, for example, to increase the radial depth of ridges 114. It is understood, however, that increasing the radial depth of ridges 114, while maintaining the outermost diameter of insert 100 will result in a decrease in the inner diameter of insert 100. This will accordingly be accompanied by a decrease in the surface area of interior compartment 102 and reduction of volume of the interior compartment 102 for housing products. In other words, any modification to any of the dimensions associated with insert 100 may result in an increase or decrease in exposed desiccant entrained surface area (or compartmental volume) depending on how the modification is made.

Referring again to FIG. 1, container body 201 material may be selected from a variety of different materials. Preferably, container body is made from one or more injection moldable plastic materials, e.g., polypropelene or polyethylene. Container body 201 includes base 203 and a sidewall 205 extending therefrom. Container body 201 has an inner surface 207 that defines an interior 231 of container body 201, and container body 201 further has an opening 233 leading into the interior 231.

Lid 220 is also preferably included. Lid 220 may be separable from container body 201 or preferably, it may be linked to container body 201 by a hinge 240 to form a flip-top container, as shown. In alternative embodiments, the lid may be a stopper, a screw cap, a foil seal—any structure that is configured to cover the opening.

In the flip-top container configuration shown, the lid 220 is pivotable about a hinge axis to move the container 200 between open and closed positions. Lid 220 is movable with respect to container body 201 to move container 200 between a closed position in which lid 220 covers the opening 233 of container body 201 and an open position in which the opening 233 is exposed. In order to close container 200, lid 220 is rotated via hinge 240 so that lid 220 seals container body 201. Lid 220 has at least one lid sealing surface 221 and container body 201 has at least one body sealing surface 202 located about the opening 233 leading to the interior 231 of container body 201. Body sealing surface 202 and lid sealing surface 221 are configured to mate to form a moisture tight seal between lid 220 and container body 201 when container 200 is in the closed position.

FIG. 2 illustrates desiccant insert 100 prior to being secured within container body 201. As shown, desiccant insert 100 can slide into container body 201 through the opening 233 in container body 201. The combined use of insert 100 and the illustrated container body 201 embodiment is merely exemplary. It should be understood that desiccant insert 100 may be used with other containers having various shapes, sizes, features, etc.

Figure 4:
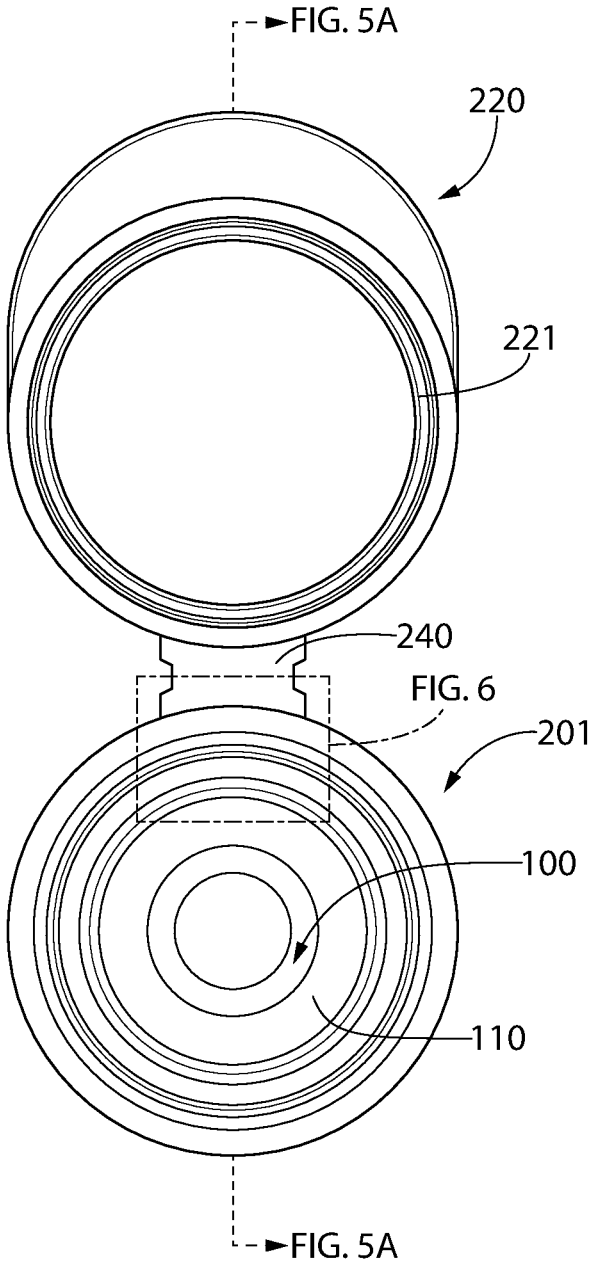
FIG. 4 is a top view of the container of FIG. 1.

FIG. 4 illustrates a top view of desiccant insert 100 after it has been inserted into container body 201. In an exemplary embodiment of the present invention, it is desirable to maximize the exposed surface area of desiccant insert 100 for moisture absorption as it sits within container body 201. Therefore, as previously described, detents 112 and ridges 114 are included to establish a void between an exposed portion of the outer surface of the insert and a portion of the inner surface of container body, wherein moisture within the void may be absorbed by exposed portion of insert 100.

Figure 5A:
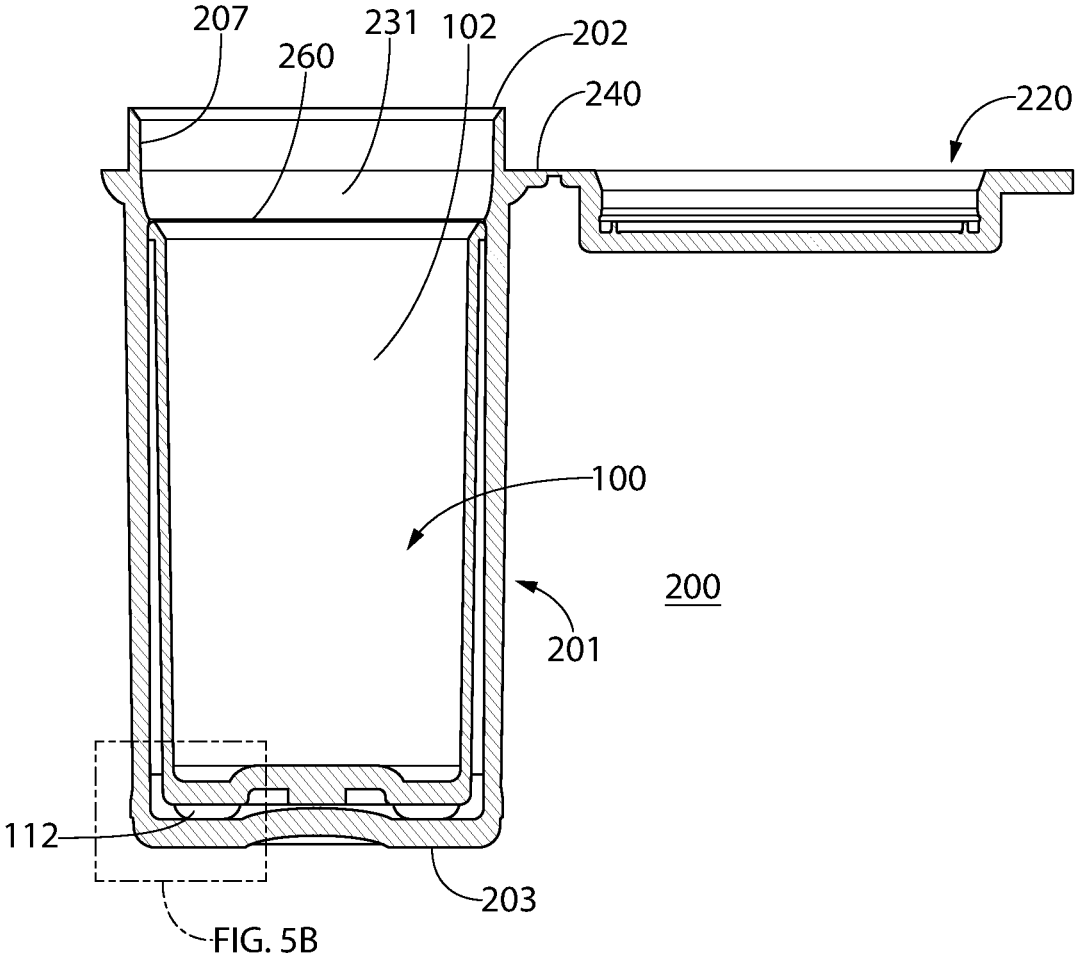
FIG. 5A is a section view of the container of FIG. 4, taken along line 5A-5A of FIG. 4.
Figure 5B:
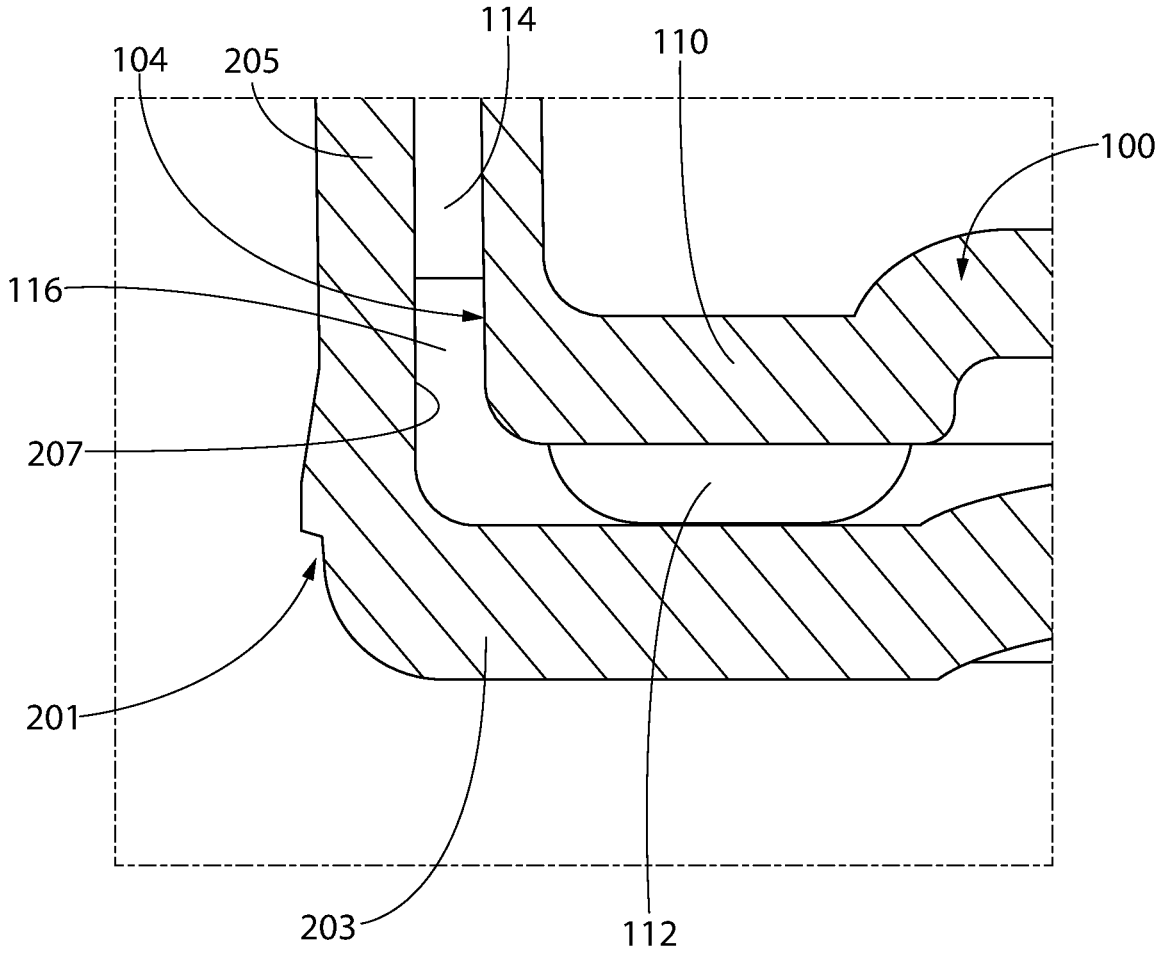
FIG. 5B is an enlarged view of a portion of the container of FIG. 5A.

FIG. 5A shows a section view of container 200 and FIG. 5B shows an enlarged view of a portion of FIG. 5A. It will be appreciated with reference to FIG. 5B that a void 116 is provided between an exposed portion of outer surface 104 of insert 100 and a portion of inner surface 207 of container body 201. Void 116 is created by virtue of the engagement between detents 112 and ridges 114 with inner surface 207 of container body 201.

As shown in FIG. 5A, container body 201 may include an annular-shaped retention ring 260 extending radially inwardly from inner surface 207 of container body 201 in order to retain insert 100 within container body 201. Retention ring 260 extends slightly beyond the outermost diameter of desiccant insert 100, so that retention ring 260 maintains desiccant insert 100 within container body 201. In one embodiment, retention ring 260 extends a sufficient amount so that desiccant insert 100 does not fall out of container body 201 when container 200 is inverted and open. In another embodiment, retention ring 260 extends a sufficient amount so that even when manual force (i.e. greater than gravitational force) is applied, desiccant insert 100 is prevented from sliding out of container 200.

Figure 6:
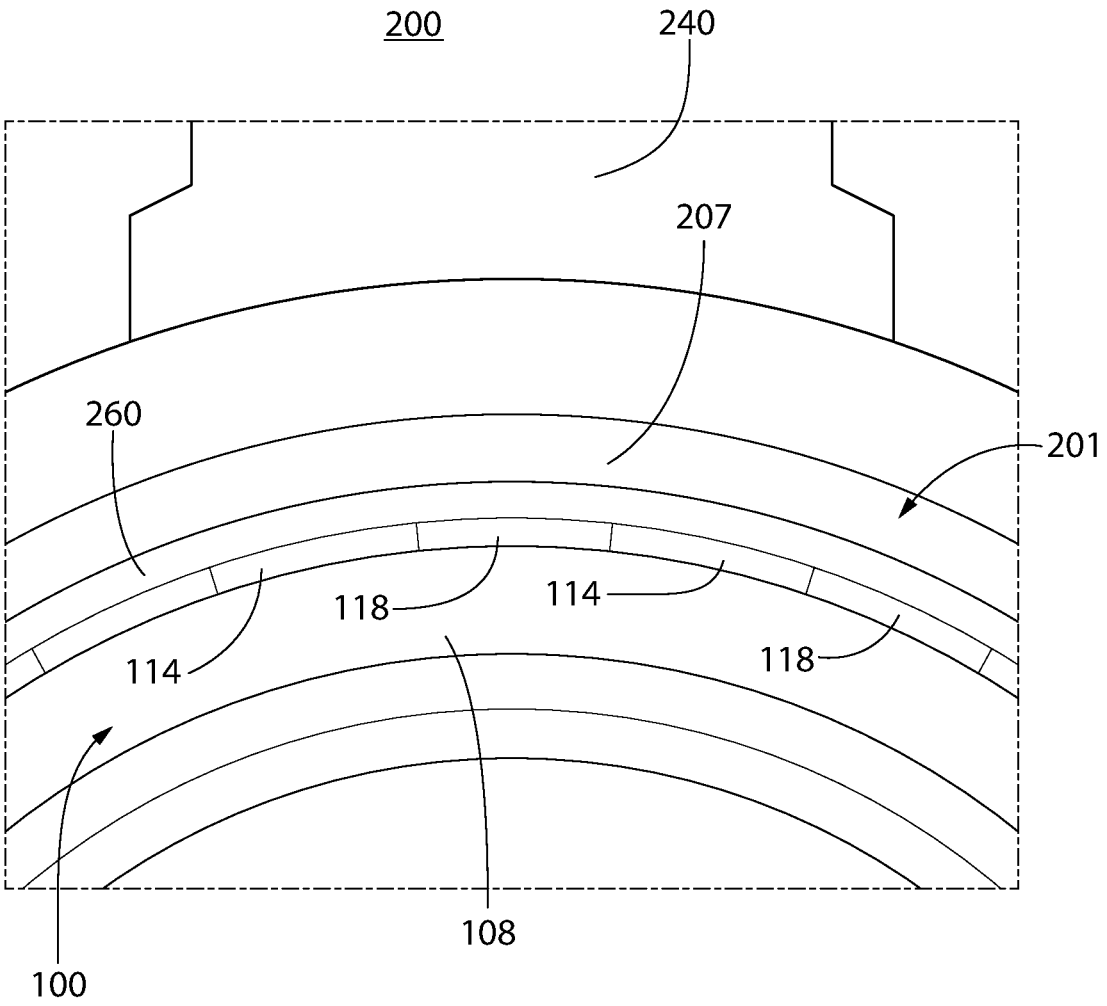
FIG. 6 is an enlarged view of a portion of the container of FIG. 4.

FIG. 6 shows an enlarged view of a portion of FIG. 4. As shown, there is at least one gap 118 between top-edge portion 108 of insert 100 and inner surface 207 of container body 201. Accordingly, it will be appreciated that gaps 118 provide corresponding fluid pathways through which void 116 (FIG. 5B) and interior compartment 102 of insert 100 can be in fluid communication. Stated differently, air within interior compartment 102 is in fluid communication with (i.e., exposed to and/or able to freely move into) void 116. It should be understood that the gaps 118 providing fluid pathways enable air to transfer relatively freely between the interior compartment 102 and the void 116. These gaps are distinguishable from the microscopic interconnecting channels through the entrained polymer that facilitate moisture vapor transmission to desiccant contained within the microscopic channels.

As stated above, a goal of the present invention is to increase the surface area over which insert 100 is exposed to air in order to facilitate absorption of moisture by desiccant insert 100. Accordingly, by providing at least one fluid pathway (e.g., through gaps 118) between void 116 and interior compartment 102 of insert 100, outer surface 104 is uniquely and advantageously exposed to air within container body 201. This facilitates greater moisture absorption by insert 100, as compared with more conventional containers wherein desiccant inserts are commonly flush with inner surfaces of container bodies and thus cannot absorb moisture from both sides.

In one alternative exemplary embodiment of the present invention, an insert is provided without ridges or detents, and instead a plurality of protrusions are provided on an inner surface of a container body. This is essentially an inverse of the configuration wherein the insert has the ridges. This alternative embodiment also creates a clearance between portions of the inner surface of the container body and the outer surface of the insert, while simultaneously securing insert within container body. In such an embodiment, an exposed outer surface of the corresponding insert is exposed to air within the interior compartment for moisture absorption.

Preferably, the insert is a blend comprising a base material and a desiccant (or other active agent), as discussed above. However, in one aspect, the invention encompasses inserts that may not include such a blend. For example, in one alternative exemplary embodiment, the insert is composed of a base material (e.g., polymer or rigid paper) with desiccant coated on either surface thereof. In another alternative embodiment, the insert is made of a polymer with a foaming agent, making it sponge-like. Optionally, in any embodiment, the base material is a non-polymeric binder, e.g., clay.

Figure 7:
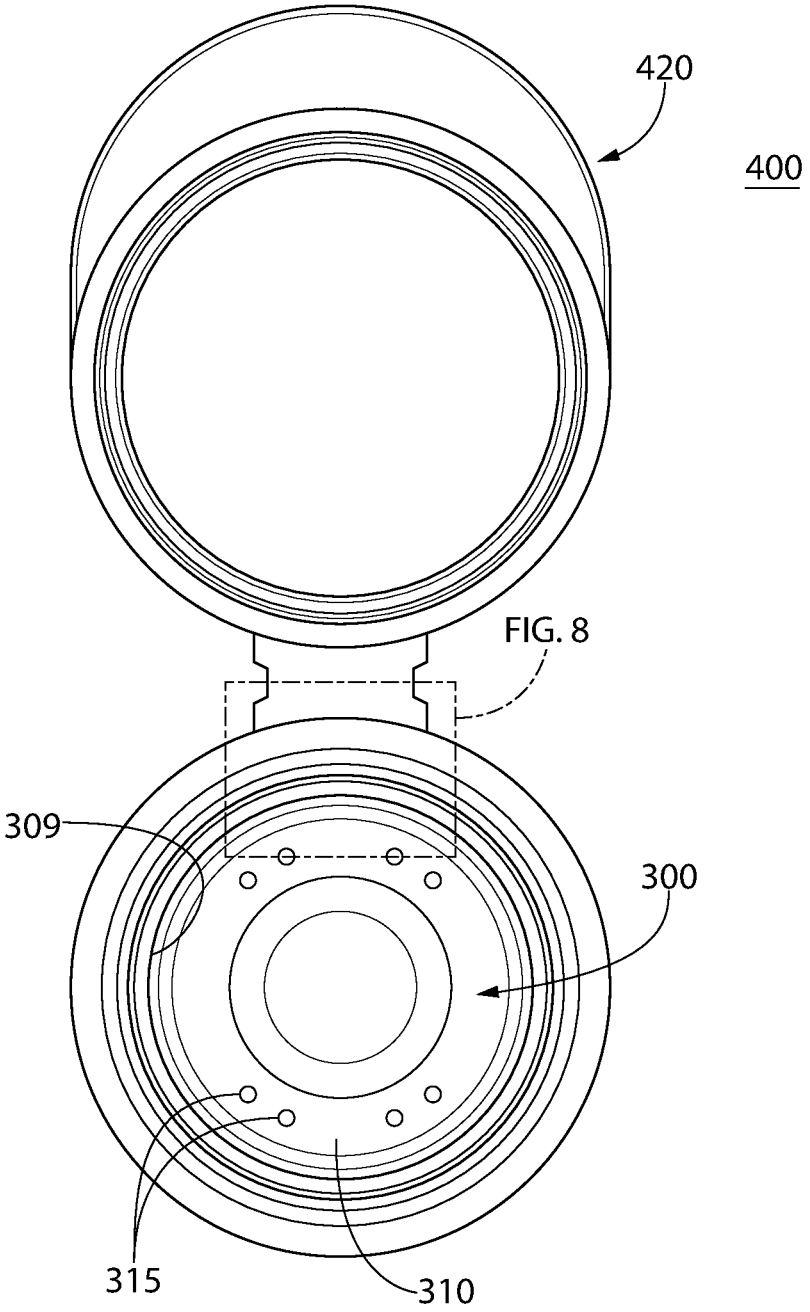
FIG. 7 is a top view of another container, in accordance with another non-limiting embodiment of the disclosed concept.
Figure 8:
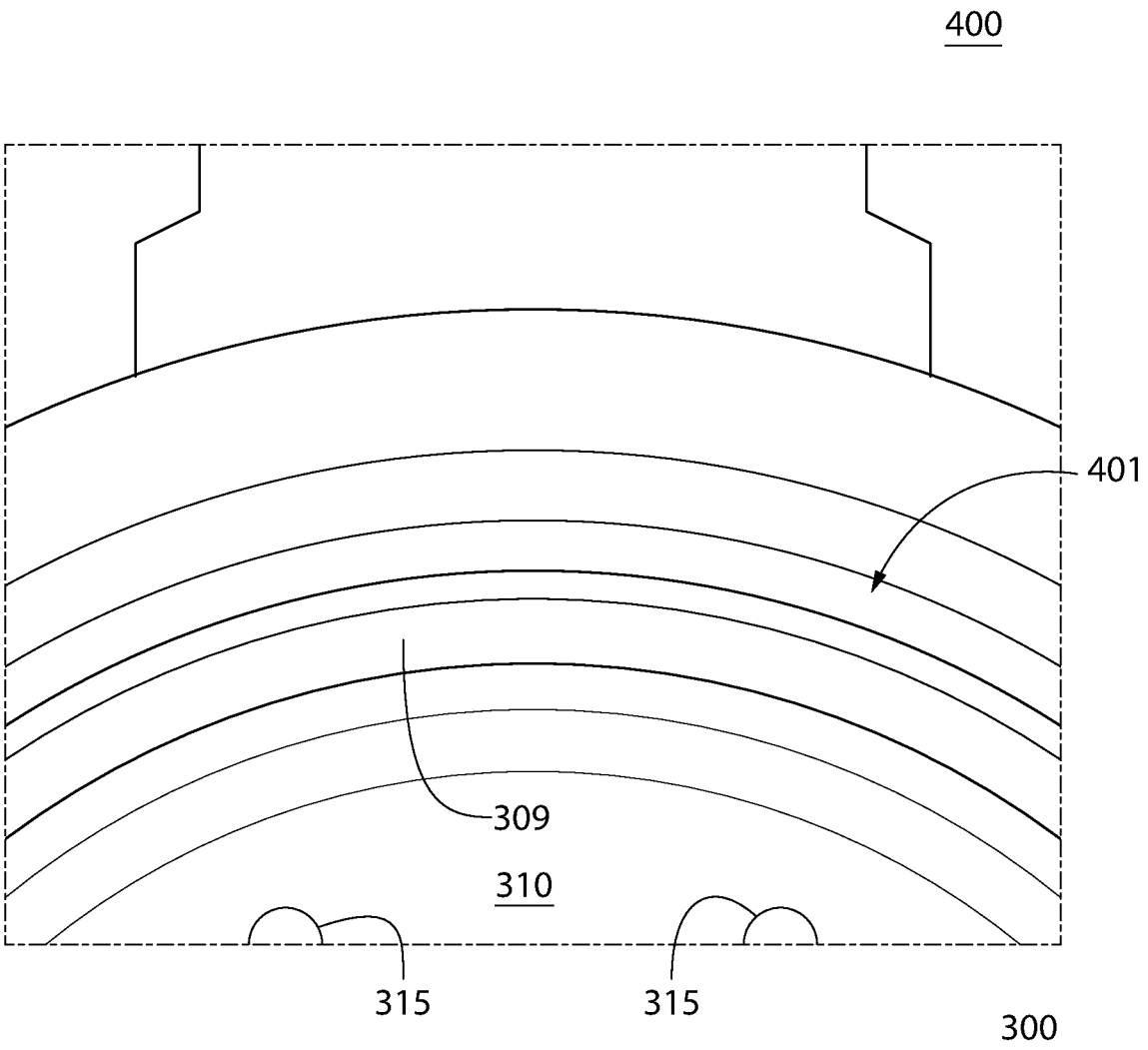
FIG. 8 is an enlarged view of a portion of the container of FIG. 7.
Figure 9:
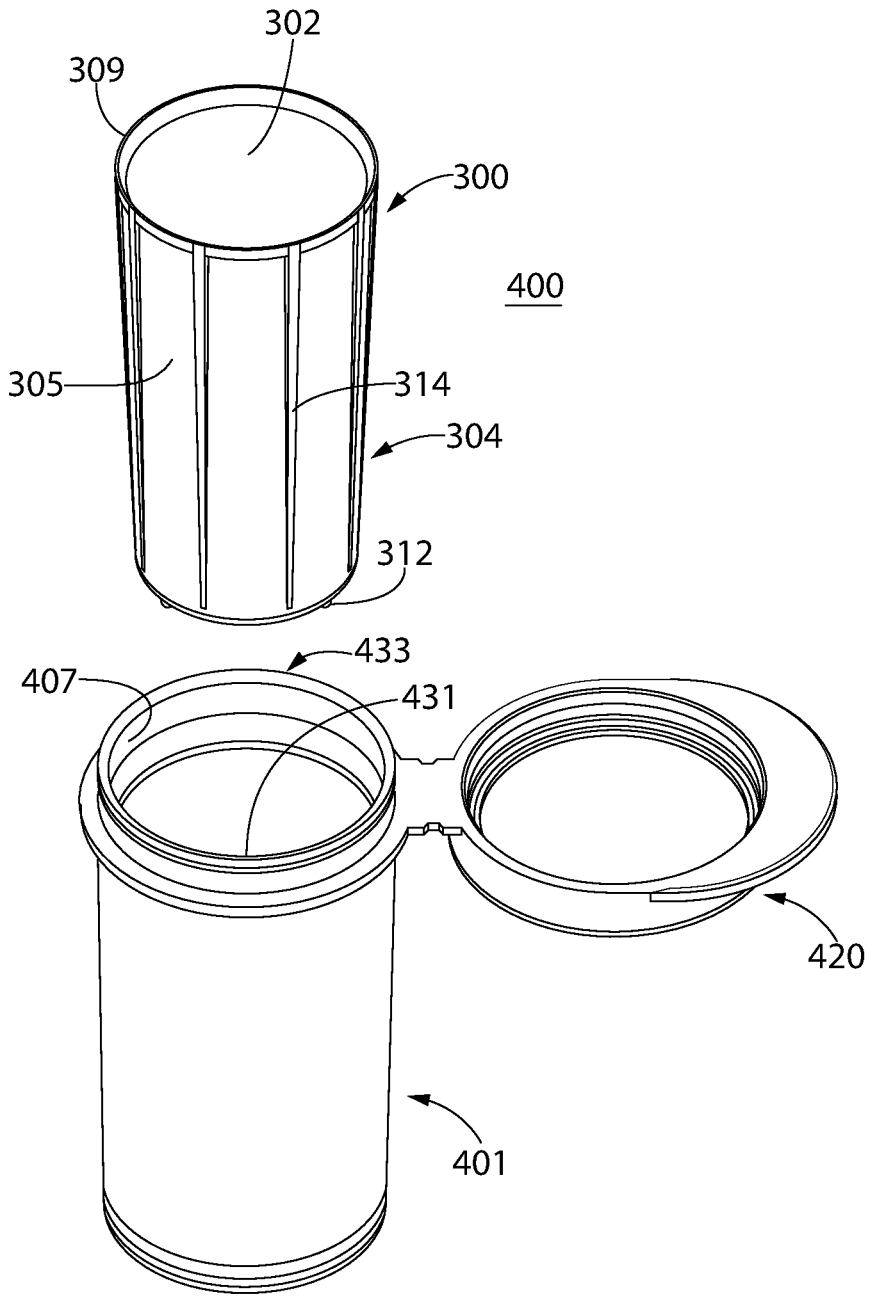
FIG. 9 is an exploded isometric view of the container of FIG. 7.
Figure 10:
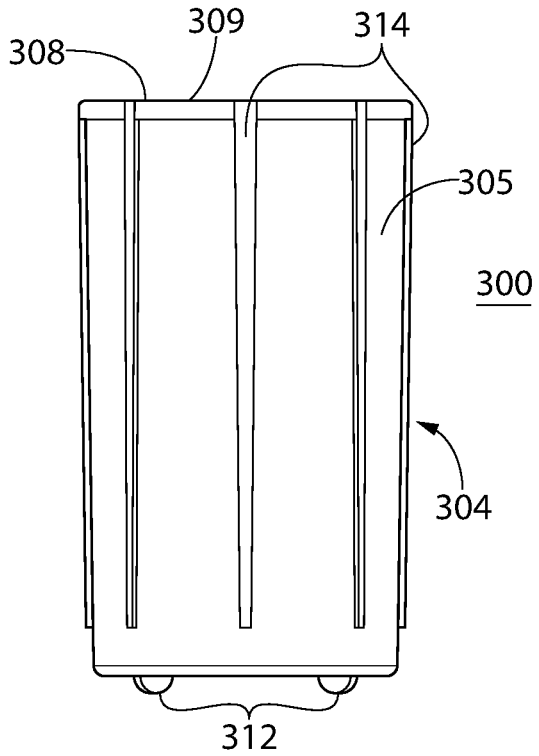
FIG. 10 and FIG. 11 are isometric views of an insert for the container of FIG. 7.
Figure 11:
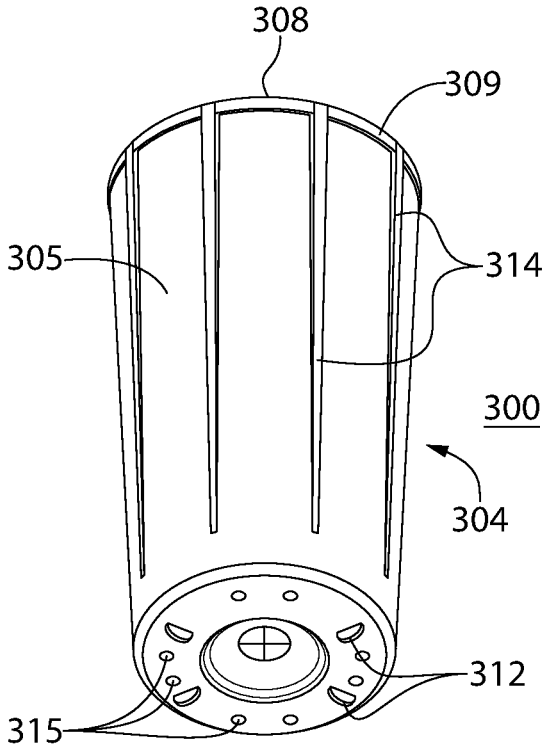

FIGS. 7-9 show different views of a container 400, and FIGS. 10-11 show different views of a desiccant insert 300 for container 400, in accordance with another non-limiting embodiment of the disclosed concept. Desiccant insert 300 provides substantially the same advantages for container 400 as desiccant insert 100 provides for container 200, discussed above. Accordingly, like components are indicated with like reference numerals.

As shown in FIGS. 10 and 11, desiccant insert 300, in addition to including detents 312 and ridges 314, further includes an annular-shaped lip 309 extending radially outwardly from top-edge 308. As such, desiccant insert 300 provides the aforementioned advantages in terms of increased surfaced area (i.e., via detents 312 and ridges 314) for improved moisture absorption, and further provides additional advantages. More specifically, lip 310 extends from top-edge 308 to an inner surface 407 (FIG. 9) of container body 401 in order to provide a barrier against fluid entry to the space between inner surface 407 (FIG. 9) of container body 401 and an outer surface 304 (FIG. 9) of insert 300. This will be appreciated with reference to FIG. 8, in which lip 309 is shown blocking fluid entry (and by extension, blocking ingress of solid materials) into this region of container 400. In other words, there are no gaps 118 as those described with respect to the above described container 200. Accordingly, the possibility for diagnostic test strips, such as blood glucose test strips that are used in diabetic care, being inadvertently inserted or stuck in this location during an automated filling operation, is significantly reduced and/or eliminated.

Furthermore, as seen in FIG. 11, bottom end 310 of insert 300 has a plurality of thru holes 315. It will be appreciated that a void (substantially akin to void 116 of container 200, shown in FIG. 5B) of container 400 is provided between an exposed portion of outer surface 304 of insert 300 a portion of inner surface 407 of container body 401. Furthermore, at least one fluid pathway is provided between the void and an interior compartment 302 (FIG. 9) of insert 300. The fluid pathway of exemplary container 400 is provided through thru holes 315. Although not shown, it will also be appreciated that thru holes could alternatively or in addition be provided on a sidewall 305 of insert in order to provide a fluid pathway between the void and interior compartment 302 of insert 300. Accordingly, moisture absorption capabilities of container 400 are significantly improved by virtue of protrusions 312,314, the resulting void and the fluid pathway through thru holes 315, as compared with more conventional containers, wherein outer surfaces of inserts are commonly flush with inner surfaces of container bodies. While the present invention has been described herein with reference to exemplary embodiments, it should be understood that the invention is not limited thereto. Those skilled in the art with an access to the teachings herein will recognize additional modifications, applications, and embodiments within the scope thereof and additional fields in which the invention would be useful.

Exemplary Methods for Making Containers

Optionally, the container 200,400 is made in an injection molding process. Such process may be at least in part according to the teachings of U.S. Pat. No. 4,783,056 or U.S. Pat. No. RE 37,676, which are incorporated by reference herein in their entireties.

In another aspect of the disclosed concept, methods for making a container 200,400 are provided. Optional methods may include the following steps: (a) providing a container body 201,401 having an opening 233,433 leading to an interior; (b) optionally providing a lid 220,420 that is movable with respect to container body 201,401 to move container 200,400 between a closed position in which lid 220,420 covers the opening 233,433 and an open position in which the opening 233,433 is exposed; (c) securing an insert 100,300 within the interior 231,431 of container body 201, 401; (d) forming a void 116 (or void of container 400) between an exposed portion of an outer surface 104,304 of insert 100,300 and a portion of an inner surface 207,407 of container body 201,401; and (e) forming at least one fluid pathway between void 116 (i.e., and a void of container 400, not shown) and an interior compartment of insert 100,300. The securing step may optionally include any one of the following: (i) press-fitting the insert 100,300 into the container body 201,401 optionally before the polymer material of the container body 201,401 is fully set such that container body 201,401 slightly shrinks about insert 100,300; or (ii) overmolding container body 201,401 around insert 100,300; or (iii) employing a two-shot molding process to make container body 201,401 and insert 100,300.

Optional Characteristics of Container and Desiccant Insert

In any embodiment, the insert according to the invention optionally has a faster moisture uptake rate than a comparable insert that is completely flush with the inner wall of the container body.

Optionally, in any embodiment, the total exposed surface area of the insert 100,300 (including inner and outer surface) is at least 1.1 times the exposed surface area of the interior compartment 102,302, optionally at least 1.25 times the exposed surface area of the interior compartment 102,302, optionally at least 1.5 times the exposed surface area of the interior compartment 102,302, optionally at least 1.75 times the exposed surface area of the interior compartment 102, 302, optionally at least 2.0 times the exposed surface area of the interior compartment 102,302, optionally at least 2.5 times the exposed surface area of the interior compartment 102,302. In a preferred embodiment of a container that Applicants reduced to practice, the total exposed surface area of the insert 100,300 is about 2.2 times the exposed surface area of the interior compartment 102,302.

Optionally, in any embodiment, the insert 100,300 is a single, unitary member, which does not rely on a separate insert or element to provide the void (e.g., 116).

Optionally, in any embodiment, the void (e.g., 116) is provided between both: (a) the bottom end 110 of the insert 100,300 and the base 203 of the container body 201; and (b) the outer surface 104,304 of the insert and the sidewall 205 of the container body 201.

Optionally, in any embodiment, the insert comprises an active agent in addition to or instead of a desiccant, e.g., an oxygen scavenger.

The invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

While the invention has been described in detail and with reference to specific examples thereof, it will be apparent to one skilled in the art that various changes and modifications can be made therein without departing from the spirit and scope thereof.

What is claimed is:

1. A container comprising:

a container body having a base and a sidewall extending therefrom, the container body having an inner surface defining an interior of the container body, the container body further having an opening leading to the interior;

a lid movable with respect to the container body to move the container between a closed position in which the lid covers the opening and an open position in which the opening is exposed; and an insert secured within the interior of the container body, the insert comprising a base material and a desiccant, wherein the base material provides structure to the insert, the insert having an opening leading to an interior compartment configured for housing products and an outer surface facing the inner surface of the container body, wherein a void is provided between an exposed portion of the outer surface of the insert and a portion of the inner surface of the container body, and wherein at least one fluid pathway is provided between the void and the interior compartment of the insert, the at least one fluid pathway being provided through a plurality of thru holes in the insert, each of the plurality of thru holes extending through a sidewall or a bottom wall of the insert from an exterior surface of the insert to the interior compartment configured for housing products.

2. The container according to claim 1, wherein the insert further has a bottom end portion and a top-edge portion disposed opposite the bottom end portion; wherein the top-edge portion defines the opening leading to the interior compartment.

3. The container according to claim 2, wherein a plurality of protrusions are provided on: a) the outer surface of the insert, or b) the inner surface of the container body; wherein the plurality of protrusions engage the inner surface of the container body.

4. The container according to claim 3, wherein the plurality of protrusions comprises ridges provided on the outer surface of the insert; and wherein the ridges extend longitudinally from proximate the top-edge portion to proximate the bottom end portion.

5. The container according to claim 4, wherein at least one of the ridges is tapered from the top-edge portion to the bottom end portion.

6. The container according to claim 4, wherein the ridges are evenly spaced from one another.

7. The container according to claim 3, wherein the plurality of protrusions comprises detents provided on the outer surface of the insert; and wherein the detents extend from the bottom end portion away from the top-edge portion.

8. A container comprising:

a container body having a base and a sidewall extending therefrom, the container body having an inner surface defining an interior of the container body, the container body further having an opening leading to the interior;

a lid movable with respect to the container body to move the container between a closed position in which the lid covers the opening and an open position in which the opening is exposed; and an insert secured within the interior of the container body, the insert comprising a base material and a desiccant, wherein the base material provides structure to the insert, the insert having an opening leading to an interior compartment configured for housing products and an outer surface facing the inner surface of the container body, the insert further has a bottom end portion and a top-edge portion disposed opposite the bottom end portion, wherein the top-edge portion defines the opening leading to the interior compartment, and wherein the at least one fluid pathway is provided through: a) at least one thru hole in the insert, or b) at least one gap between the top-edge portion and the inner surface of the container body, the insert further having an annular-shaped lip extending radially outwardly from the top-edge portion to the inner surface of the container body, wherein a void is provided between an exposed portion of the outer surface of the insert and a portion of the inner surface of the container body, and wherein at least one fluid pathway is provided between the void and the interior compartment of the insert.

9. The container according to claim 1, wherein the container body further has an annular-shaped retention ring extending radially inwardly from the inner surface of the container body in order to retain the insert within the container body.

10. The container according to claim 1, wherein the lid is linked to the body by a hinge.

11. The container according to claim 1, wherein the lid comprises a lid sealing surface; wherein the container body further has a body sealing surface disposed about the opening leading to the interior of the container body; and wherein the body sealing surface and the lid sealing surface are configured to mate to form a moisture tight seal between the lid and the body when the container is in the closed position.

12. A container comprising:

a container body having a base and a sidewall extending therefrom, the container body having an inner surface defining an interior of the container body, the container body further having an opening leading to the interior and a body sealing surface is disposed about the opening;

a lid movable with respect to the container body to move the container between a closed position in which the lid covers the opening and an open position in which the opening is exposed, the lid comprising a lid sealing surface; and an insert secured within the interior of the container body, the insert comprising a base material and a desiccant, wherein the base material provides structure to the insert, the insert having an opening leading to an interior compartment configured for housing products and an outer surface facing the inner surface of the container body, wherein a void is provided between an exposed portion of the outer surface of the insert and a portion of the inner surface of the container body, wherein at least one fluid pathway is provided between the void and the interior compartment of the insert, wherein the body sealing surface and the lid sealing surface are configured to mate to form a moisture tight seal between the lid and the body when the container is in the closed position, and wherein the container has a moisture ingress of less than 1000 micrograms per day, at 80% relative humidity and 22.2 degrees C.

13. The container according to claim 1, wherein the insert comprises a blend of the base material and the desiccant.

14. The container according to claim 13, wherein the insert is an entrained polymer further comprising a channeling agent.

15. The container according to claim 1, wherein the insert has a total exposed surface area that is at least 1.75 times an exposed surface area of the interior compartment.

16. The container according to claim 1, wherein the insert is a single, unitary member.

17. The container according to claim 1, wherein the void is provided between both: (a) a bottom end of the insert and the base of the container body; and (b) the outer surface of the insert and the sidewall of the container body.

18. An insert for a container, the insert comprising:

a bottom end portion; and a top-edge portion disposed opposite the bottom end portion, a sidewall extending from the bottom end portion to the top-edge portion, the top-edge portion defining an opening leading to an interior compartment configured for housing product, wherein a plurality of thru holes extend through the insert, the plurality of thru holes being configured to serve as a fluid pathway from or to the interior compartment; and wherein the insert further comprises a mixture of a base material and a desiccant, the base providing structure to the insert, wherein the insert further comprises one or more ridges extending outwardly from the sidewall of the insert, wherein at least one of the one or more ridges is tapered from the top-edge portion to the bottom end portion.

19. The insert according to claim 18, wherein the plurality of thru holes extend through the bottom end portion of the insert.

20. The insert according to claim 18, wherein the insert further has an annular-shaped lip extending radially outwardly from the top-edge portion thereof.

21. The insert according to claim 18, wherein the plurality of thru holes extend through the sidewall of the insert.

22. The insert according to claim 18, further comprising one or more detents extending outwardly from the bottom end portion of the insert.

23. The insert according to claim 18, wherein the desiccant is entrained in the base polymer.

24. The insert according to claim 23, wherein the insert further comprises a channeling agent.

* * * * *